United States Patent [19]

Rogers

[11] 4,261,067

[45] Apr. 14, 1981

[54] BEDSPREAD SUPPORTING FOLDING CANOPY FRAME

[76] Inventor: Robert J. Rogers, 3829 NW. 18, Oklahoma City, Okla. 73107

[21] Appl. No.: 62,876

[22] Filed: Aug. 1, 1979

[51] Int. Cl.[3] ..... A47C 19/04

[52] U.S. Cl. ..... 5/414; 5/508; 248/281.1; 248/240.4

[58] Field of Search ..... 5/414, 421, 508, 512; 248/240.4, 281.1, 293; 312/280, 2, 314, 317

[56] References Cited

U.S. PATENT DOCUMENTS

| | | | |
|---|---|---|---|
| 1,696,286 | 12/1928 | Smith | 5/414 |
| 1,892,687 | 1/1933 | Teufel | 248/293 |
| 3,600,728 | 8/1971 | Kinzel | 5/414 |
| 4,080,530 | 3/1978 | Krosgsrud | 248/280.1 |

*Primary Examiner*—Casmir A. Nunberg
*Attorney, Agent, or Firm*—Robert K. Rhea

[57] ABSTRACT

A rectangular frame, connected at one end with the headboard of the bed, normally overlies the marginal edges of the bed and supports a bedspread in bed made-up position. The frame and overlying bedspread is pivoted upwardly against the headboard to a canopy position for sleeping.

1 Claim, 6 Drawing Figures

BEDSPREAD SUPPORTING FOLDING CANOPY FRAME

BACKGROUND OF THE INVENTION

1. Field of the Invention

The present invention relates to beds and more particularly to a bed connected frame overlying the marginal edges of a bed and underlying a bedspread for forming a partial canopy when pivoted upwardly for sleeping.

2. Description of the Prior Art

Canopies are well known but are formed by a rigid fixed position frame. This invention is directed toward a frame foldable from a bedspread underlying position to a bedspread lifted canopy-like position.

SUMMARY OF THE INVENTION

A rectangular open generally U-shaped frame is connected at one end with the headboard end portion of a bed and overlies the marginal sides and opposite end portion of the bed below a bedspread covering the bed. The frame legs are articulated intermediate their ends permitting the headboard end portion of the frame to be pivoted upwardly about horizontal axes to a vertical position at the headboard end of the bed and disposing the opposite foot end portion of the frame horizontally during night time hours. A plurality of slats, extending transversely of the frame legs, support the bedspread on the frame during the raising and lowering action of the frame.

The principal object is to provide a bedspread support movable from a bed made-up position to an elevated canopy-type position at the headboard end of the bed and vice versa.

DESCRIPTION OF THE PREFERRED EMBODIMENTS

Figure 2:
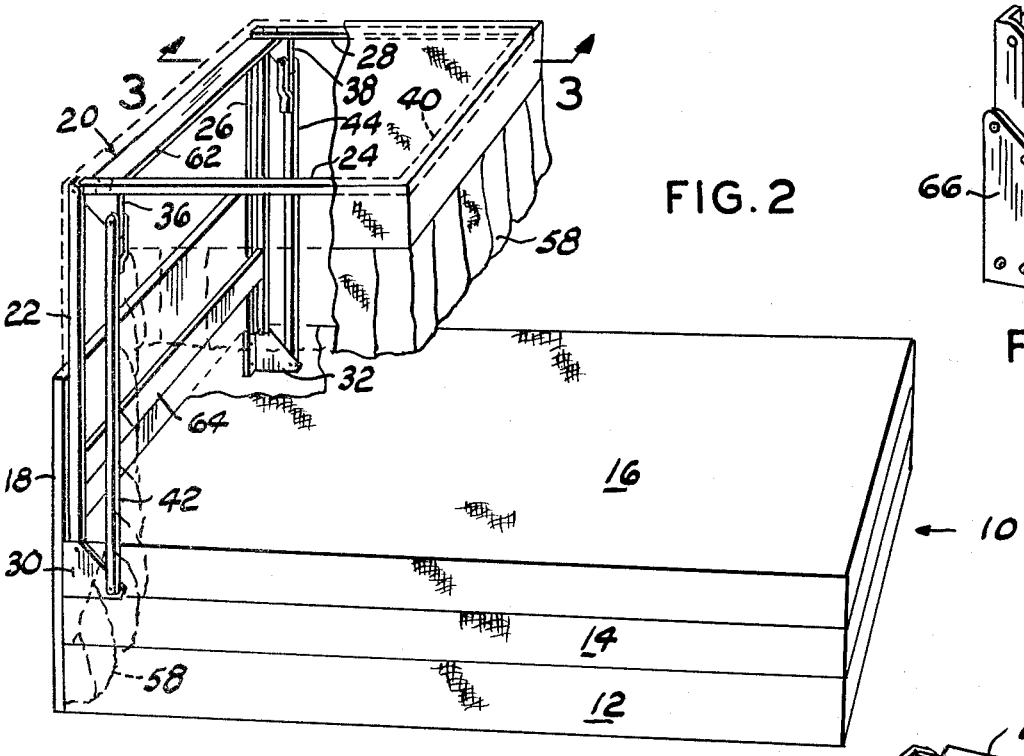
FIG. 2 is a perspective view, with parts broken away for clarity, of the frame when elevated to bedspread canopy position.

Like characters of reference designate like parts in those figures of the drawings in which they occur.

In the drawings:

The reference numeral 10 indicates a conventional bed comprising a bed frame 12 having box springs 14 and a mattress 16 superposed thereon and having a headboard 18 at one end of the bed.

The reference numeral 20 indicates the bedspread supporting frame, as a whole, which is rectangular flat-like in general configuration.

Figure 3:
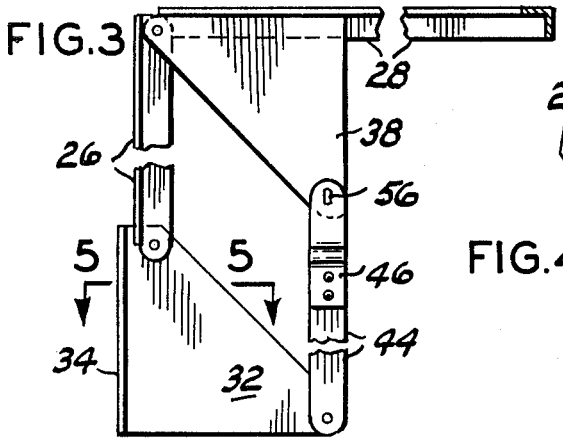
FIG. 3 is a fragmentary elevational view, to a larger scale, of one side of the frame looking in the direction of the arrows 3—3 of FIG. 2 with the frame leg interconnecting slats removed for clarity.
Figure 5:
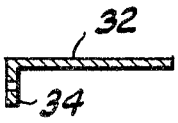
FIG. 5 is a horizontal sectional view taken substantially along the line 5—5 of FIG. 3; and, FIG. 6 is a perspective view of an alternative frame anchor member.

The frame legs are formed by longitudinally aligned angle members or rails 22–24 and 26–28, respectively, which are coextensive with the length of the bed. A pair of right triangular-shaped frame anchors 30 and 32, each having an upright flanged edge 34, (FIGS. 3 and 5) with its hypotensue inclined upwardly toward the headboard, are connected by the flanged edge to the adjacent surface of the headboard 18 at opposite sides of the mattress. One end portion of the leg rails 22 and 26 is pivotally connected with the upper end portion of the respective anchor member hypotenuse. A pair of right triangular hinge plates 36 and 38 are respectively disposed at opposing sides of the mattress 16 intermediate its ends with the hypotenuse of each plate parallel with the respective hypotenuse of the members 30 and 32. The other end portion of the leg rails 22 and 26 are respectively pivotally connected with the hinge plates 36 and 38 at the upper end portion of their hypotenuse. One end portion of the foot end portion frame leg rails 24 and 28 is rigidly connected with the upper edge portion of the respective hinge plate 36 and 38. The hinge plates 36 and 38 thus form a horizontal axis hinge connection between the respective dual rail frame legs for the purposes presently explained.

The other end portion of the foot end portion leg rails 24 and 28 are rigidly interconnected by a frame end member 40 coextensive with the width of the mattress and overlying the upper limit of its foot end marginal edge. A pair of bars 42 and 44 extend between and are pivotally connected with the hypotenuse depending end portion of the frame anchors 30 and 32 and hinge plates 36 and 38, respectively, at opposing sides of the frame and parallel with the frame headboard end leg rails 22 and 26. The purpose of the bars 42 and 44 is to dispose the foot end portion of the frame horizontally when the headboard end portion of the frame is vertically disposed, as presently explained.

Figure 4:
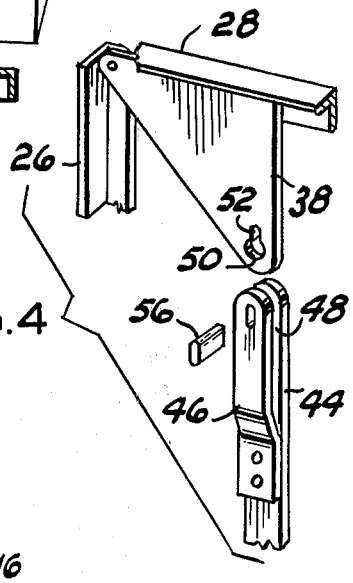
FIG. 4 is a fragmentary exploded perspective view illustrating the manner of locking the frame in lifted position.
Figure 1:
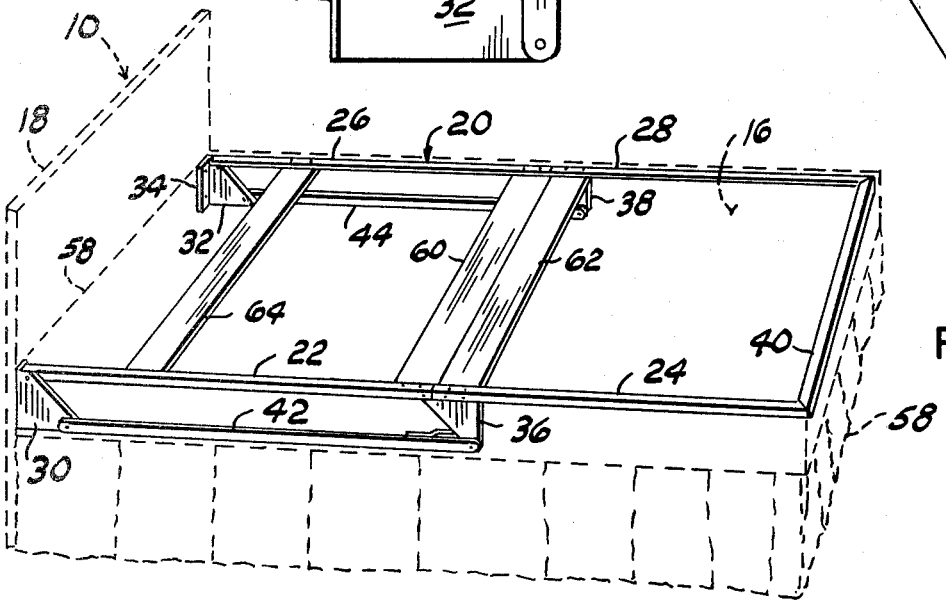
FIG. 1 is a perspective view of the bedspread supporting frame overlying a bed and underlying a bedspread, the latter being shown by dotted lines.

As illustrated by FIG. 4, the hinge plate connected end portion of the respective bar 42 and 44 substantially describes a clevis formed by a short length of bar material 46 similar to the bar 44 and attached thereto in offset parallel relation to form a slot 48 for pivotally and slidably receiving the depending end portion of the hinge plate 38 hypotenuse therebetween. The hinge plate 38 is provided with an aperture 50 and a communicating vertical slot 52, as viewed in FIG. 4. The clevis-like end of the bar 44 is transversely slotted, as at 54, for receiving an elongated rectangular-like pin 56 dimensioned for rotation within the arcuate portion of the hinge plate aperture 50 and capable of entering the slot 52 when the foot end portion of the frame is horizontally disposed thus locking the frame in an upright canopy-like position.

The frame legs or rails are transversely interconnected by a plurality of panel-like slats for supporting a bedspread 58 during the raising and lowering action of the frame, as hereinafter described. As illustrated in the drawings, a pair of slats 60 and 62, disposed adjacent parallel relation, extend between and are respectively connected with the hingedly connected end portion of the leg rails 22–26 and rigidly connected end portion of the leg rails 24–28 to insure support of the bedspread 58 at the hinged position of the frame. A third slat 64 transversely interconnects the leg rails 22–26 in spaced relation with respect to the headboard a distance sufficient to extend toward the foot of the bed beyond pillows, not shown, overlying the bed at its headboard end portion. Obviously, additional slats or panels, neither being shown, may transversely interconnect the frame leg rails in accordance with the mass of the bedspread 58.

Figure 6:
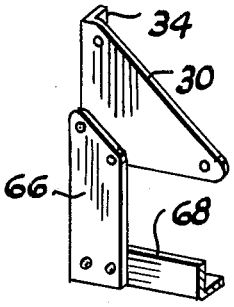

On beds not equipped with a headboard the frame anchors 30 and 32 may be equipped with an extension 66 (FIG. 6) which is secured to and depends from the respective frame anchor and is secured to the bed frame 68.

OPERATION

In operation, the frame 20 is connected with the headboard 18 or bed frame 68, as described hereinabove, and overlies the marginal edge portions of the bed. The bedspread 58 overlies the frame and bed when the bed is not in use thus presenting a neat appearance. When retiring the user manually lifts the frame and bedspread by grasping the foot end portion 40 of the frame which, by the action of the bars 42 and 44 during the lifting action and pivoting movement of the frame legs relative to the frame anchors 30 and 32, disposes the frame leg rails 22 and 26 adjacent and parallel with the headboard 18 and disposes the foot end portion of the frame horizontally wherein the pins 56 entering the slots 52 lock the frame and bedspread in the elevated canopy-like position of FIG. 2. Upon rising, after making-up the sheets or blankets, not shown, overlying the mattress the user lowers the frame and bedspread by manually lifting the foot end portion of the frame slightly so that the pins 56 are released from the slots 52 and as the frame is pulled toward the foot end portion of the bed the pins 56 rotate in the hinge plate apertures 50 as the frame and bedspread are lowered toward the bed. During the lowering action of the frame and bedspread ambient air resistance against the bedspread flares its marginal edges outwardly in a billowing umbrella-like action so that the marginal edge portions of the bedspread are flared outwardly with respect to the marginal edge portions of the bed and settle thereagainst when the frame is horizontally disposed on the mattress thus returning the bed to its previous neatly made-up position.

Obviously the invention is susceptible to changes or alterations without defeating its practicability. Therefore, I do not wish to be confined to the preferred embodiment shown in the drawings and described herein.

I claim:

1. In a bed having opposing sides and a head and foot end portions and having an overlying bedspread, the improvement comprising:

a generally U-shaped frame having a head end portion and a foot end portion interposed between said bedspread and said bed, said frame having articulated legs and a bight portion respectively overlying marginal side edge and foot portions of said bed;

a plurality of panels extending transversely between and connected with said legs;

anchor plate means interposed between said legs and the head end portion of said bed for forming a horizontal axis;

hinge plate means interposed in each said leg for forming the articulated leg joint; and, a bar extending between and pivotally connected with the respective said anchor plate means and said hinge plate means in spaced parallel relation with the respective adjacent head end portion of said legs for maintaining the foot end portion of said frame horizontally disposed during pivoting movement of the respective end portions of said frame about the horizontal axis toward and away from said bed, said hinge means including a plate having an aperture for receiving a pin forming the pivotal connection with the respective said bar and in which at least one said hinge plate is provided with a slot communicating with the aperture for nesting an intermediate portion of said pin when said frame is in an elevated position.

* * * * *